United States Patent [19]

Fujimura et al.

[11] 4,134,763

[45] Jan. 16, 1979

[54] SELENIUM-BASE PHOTOSENSITIVE MATERIALS FOR ELECTROPHOTOGRAPHY HAVING SUPER-FINISHED SUBSTRATE

[75] Inventors: Itaru Fujimura; Katutoshi Endo, both of Tokyo, Japan

[73] Assignee: Ricoh Co., Ltd., Tokyo, Japan

[21] Appl. No.: 817,256

[22] Filed: Jul. 20, 1977

[30] Foreign Application Priority Data

Jul. 23, 1976 [JP] Japan ..... 51-87234

[51] Int. Cl.[2] ..... G03G 5/04; G03G 8/00

[52] U.S. Cl. ..... 96/1.5 R; 51/281 R; 51/DIG. 2; 427/299; 427/327; 156/645

[58] Field of Search ..... 96/1.5; 427/76, 299, 427/327; 51/DIG. 2, 281 R; 156/645

[56] References Cited

FOREIGN PATENT DOCUMENTS 973683 10/1964 United Kingdom ..... 96/1.5

*Primary Examiner*—John D. Welsh

*Attorney, Agent, or Firm*—Blanchard, Flynn, Thiel, Boutell & Tanis

[57] ABSTRACT

Selenium-base photosensitive materials for use in electrophotography wherein a photoconductive layer consisting essentially of selenium is formed on a substrate whose surface is made rougher by a super-finish method.

9 Claims, 5 Drawing Figures

SELENIUM-BASE PHOTOSENSITIVE MATERIALS FOR ELECTROPHOTOGRAPHY HAVING SUPER-FINISHED SUBSTRATE

BACKGROUND OF THE INVENTION

This invention relates to selenium-base photosensitive materials for electrophotography and more particularly to photosensitive materials comprising selenium or selenium alloys prepared by depositing selenium or selenium alloys or super-finish treated substrates.

Conventionally, the selenium-base photosensitive materials for use in electrophotography are prepared by depositing a thin layer of selenium or selenium-base photoconductive material on a conductive substrate by vacuum evaporation, or the like.

The photoconductive layer of the selenium or selenium alloy photoconductors (hereinafter simply referred to as the "selenium layer") is electrically charged and is then exposed to a light image pattern, thus a latent electrostatic image is formed on the photoconductive layer. During this process, charge carriers move through the selenium layer and the conductive substrate.

Therefore, the characteristics of the photosensitive members are affected greatly, particularly by the condition of the boundary surface between the selenium layer and the substrate.

Aluminum-base materials, stainless steel or the like have been used as the materials of the substrates for use with selenium or selenium-base photoconductors. In particular, aluminum-base substrates are most commonly used since they are inexpensive and easy to handle.

In the case of a mirror-finished substrate, it has a shortcoming of being difficult to handle because a deposoted selenium layer is easily peeled off the substrate by a slight shock or vibrations.

Therefore, various studies have been made to improve the adhesive property between selenium photoconductive layers and substrates. For example, as disclosed in Japanese Published Patent No. 44-32468, there is a method of placing an organic adhesive layer on a substrate as an intermediate layer and then depositing a selenium layer on the intermediate layer by vacuum evaporation.

However, this method involves very difficult technical problems. For instance, in producing such a photoconductive member, it is difficult to form a uniform organic adhesive layer. Moreover, the vacuum degree during vacuum evaporation of selenium is lowered by the emission of gases from the organic adhesive layer due to the heating of the substrate during the vacuum evaporation and also the selenium layer is apt to be contaminated with some impurities from the organic adhesive layer.

When the above mentioned selenium photosensitive materials is used in the conventional electrophotographic processes, such as Carlson process, some traps are apt to be generated, which trap electric carriers in the organic adhesive layer and the selenium layer, inevitably causing the generation of residual potential.

As can be seen from the above example, the attempt of increasing the adhesiveness between the substrate and the selenium layer, by placing such an intermediate layer in between, involves not only the problem of impairing the electrostatic characteristics of the photosensitive materials, but also the difficulty in making a suitable selection of organic materials for use in the intermediate adhesive layer.

Another method of improving the adhesiveness between the substrate and the selenium layer is the making of the surface of substrate uneven or rough so that the adhesion between the selenium layer and the substrate is improved.

As a method belonging to this method, there is a liquid honing process, in which water containing dispersed abrasive particles is injected against the surface of a substrate. Locally, the surface is made rough enough by this method and accordingly the adhesion between the substrate and a selenium layer is appreciably increased. However, a problem with this is that it causes the substrate to have a rather long periodical undulation on the surface. Thus, even if a selenium layer was formed on this substrate, it is not always an uniformly thick, with the result that it has adverse effects on image formation. Moreover, in case the surface of a substrate is made excessively uneven, the electrostatic characteristics of the selenium photosensitive material, such as the surface electric potential (hereinafter referred to as the surface potential) thereof, are impaired.

In this case, the problem is at what surface potential (V) the photosensitive member should be used since in actual copying apparatus, the maximum permissible roughness of the substrate is determined by the surface potential required.

In general, it is said that a photosensitive material with not more than 1250 V of surface potential and with not more than 0.80 of dark decay ratio is not suitable for use.

Furthermore, when the photosensitive material is re-used, the selenium layer has to be peeled off the substrate. In this case, when the substrate is too rough, the peeling off of the selenium layer becomes difficult.

Therefore, the liquid honing method has shortcomings, such as occurrence of a rather long periodical undulation on the surface of a substrate and the difficulty in balancing the increased adhesiveness of the selenium layer with reduction of difficulty in the peeling off of the selenium layer when re-used.

SUMMARY OF THE INVENTION

Accordingly, it is the general purpose and object of the present invention to improve the adhesiveness of the photoconductive layers to the substrates thereof of the photosensitive materials utilizing selenium or selenium alloys for use in electrophotography.

Another object of this invention is to provide photosensitive materials utilizing selenium or selenium alloys which can be practically well used in terms of electrostatic characteristics and whose selenium layers can be easily peeled off when re-used.

These and other objects are accomplished within the present invention by making the surface of a substrate rougher by a super-finish method and forming a photoconductive layer consisting essentially of selenium on the substrate.

The super-finish method employed in the present invention signifies a method of grinding a substrate in the manner in which a grinding stone is brought into light pressure contact with the surface of the substrate with small vibrations, while the grinding stone is moved on the substrate. This method accomplishes a uniform and highly accurate grinding, forming a minute roughness on the substrate in a short time and rarely causing the hardening of the ground surface through such grinding.

DETAILED DESCRIPTION OF PREFERRED EMBODIMENTS

The condition under which the super-finish method is employed can be varied. However, in the present invention, it is preferable to perform grinding by the super-finish method under the following conditions:

Kind of Grinding Stone: FBB GC 600–GC 1200 made by Nihon Tokushu Kento (GC 1000 6R - 4.5 is the best.)
Number of Vibrations of Grinding Stone: 2000–2500 cpm
Grinding Amplitude: 1.5–2.5 mm
Grinding Speed: 250–350 mm/min
Number of Rotations of Grinding Stone: 200–250 rpm
Grinding Pressure: 0.8 ± 0.1 kg/cm$^2$
Grinding Liquid: Union Base + Kerosene The super-finish method permits strong adhesion of a selenium layer to a substrate even if the surface roughness of the substrate is not more than 2.0μ. Furthermore, it causes little undulation having a long period on the surface and the selenium layer formed on the substrate can be easily peeled off the substrate when reused.

However, when the surface roughness of the substrate becomes less than 0.3μ, the adhesiveness of the selenium layer to the substrate weakens.

Consequently, in the present invention, it is preferable for the surface roughness to be in the range of approximately 0.3 to 2.0μ.

There is a difference between the super-finish method and the liquid honing method in the relationship between the formed surface roughness and the adhesiveness. The reason for this is possibly that there are some differences in the shape of the formed roughness.

Figure 1:
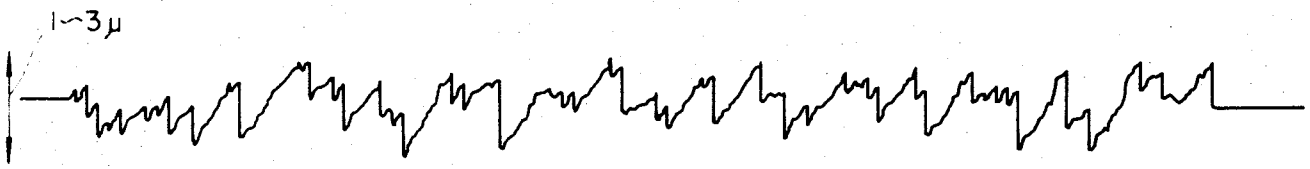
FIG. 1 shows a measurement result of the surface unevenness or roughness of a super-finish treated Al-Mn substrate, obtained by a Kosaka-type roughness meter (a stylus contacting type).
Figure 2:
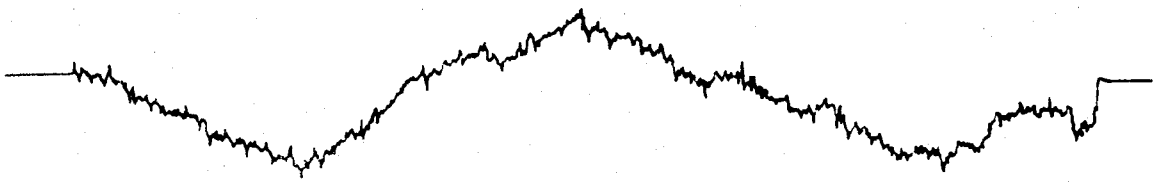
FIG. 2 shows a measurement result of the surface roughness of the super-finished Al-Mn substrate of FIG. 1 followed by liquid honing finish, obtained by the Kosaka-type roughness meter.

FIGS. 1–2 are to explain such differences between the super-finish and the liquid honing in the shape of the formed roughness.

FIG. 1 shows a measurement result of the surface roughness of a substrate comprising an Al-Mn material which was subjected to the super-finish under the condition of Example 1 described later. The roughness meter utilized in this measurement was a Kosaka-type roughness meter of 10,000 magnifications in the vertical direction and of 100 magnifications in the horizontal direction. The surface was found to be of the roughness of an average of 1.3–1.4μ and without any undulation.

FIG. 2 shows a measurement result of the surface roughness of the super-finished Al-Mn substrate of FIG. 1 followed by liquid honing finish under the following condition. As can be seen from this result, the surface has a uniform roughness, but has an undulation.

Abrasive : Carborundum (Fujimi #4000)
Water Pressure : 3–3.5 kg/cm$^2$
Grinding Time : 4 minutes
Distance between water outlet and surface of substrate : about 10 cm
Injection Angle of Grinding Liquid : 90°

When the substrate was directly subjected to the liquid honing finish without the super-finish under the above condition, an undulation of the surface was observed. Therefore, such undulation was still observed on the selenium layer when selenium was deposited by vacuum evaporation on the substrate.

When the surface roughness of the substrate was more than 2.0μ, the electrostatic characteristics of the photosensitive material were found impaired.

The selenium layer can be peeled off the substrate by placing the photoconductive material in the liquid or vapor of trichloroethylene or of perchloroethylene at elevated temperatures of 70°–100° C. for about 1–5 minutes.

The other photosensitive materials that can be employed in this invention are the materials consisting essentially of selenium, such as the alloys of selenium and tellurium and/or arsenic, in addition to amorphous selenium which is usually used in the field of this invention.

It is preferable for the thickness of the photoconductive layers utilizing these photoconductors to be in the range of about 30–80μ. When the photoconductive layer is thinner than 30μ, the charging characteristic becomes impaired. On the other hand, when it is thicker than 80μ, the residual potentials tend to become intolerably high.

Furthermore, in the present invention, if necessary, an overcoat layer, comprising organic polymers or inorganic materials as the principal constituent, can be placed on the photoconductor to prevent the abrasion of the surface of the photoconductive layer.

There are two types of overcoat layers that can be utilized in this invention, namely, organic overcoat layers and inorganic overcoat layers.

As the materials for use in the organic overcoat layers, the following compounds or the mixtures thereof, for example, can be used: polyvinyl formal, polyvinyl butyral, polyvinyl acetal, polystyrene, polyethylene terephthalate, fluorine atom contained polymers, silicone resin, acrylic resin, cellulose resin, silane coupling resin, polyvinylcarbazol, or the mixtures of these compounds. Furthermore, if necessary, they can be used with the addition of various types of additives.

As the materials for use in the inorganic overcoat layers, the following compounds, for example, are used solely or in combination: $Al_2O_3$, $SiO_2$, $TiO_2$, CaO, PbS, $Fe_2O_3$, barium titanate, inorganic glass, $SnO_2$, or other metal oxides, metal sulfides and metal fluorides.

As the materials of the substrates for use in the photoconductors, any conductive material can be used if it is utilized in the field of this invention, for instance, in addition to aluminum, metals with a surface resistivity of approximately not more than $10^9$ ohm. cm, such as stainless steel, brass or the like.

Thus, the principal object of the present invention, that is, the increasing of the adhesiveness between the selenium layers and the substrates, and the removing of the difficulty in the peeling off of the selenium layers can be accomplished without impairing the electrostatic characteristics of the photosensitive materials.

Additionally, the inventors of the present invention investigated the changes of electrostatic characteristics of the photosensitive materials with time from the view point of the materials of substrates.

In order to provide a suitable photosensitive material for use in electrophotograhy, it is an indispensable condition that the initial electrostatic characteristics of the photosensitive material be satisfactory. Moreover, in the case of electrophotographic copying apparatus, it is also desirable that the initial copy quality be maintained throughout continuous multiple coping. Accordingly, it is required that a photoconductor for use in electrophotography be free from any deterioration with time in terms of electric characteristics.

The results of the investigation by the inventors of the present invention show that when attention is paid only to the initial electric characteristics of the electrophotographic selenium photosensitive material in view of the substrate therefor, the initial characteristics are not changed depending upon the kinds of substrates if the substrates are treated by the super-finish method.

However, with respect to the change of electric characteristics with time, only slight differences were observed depending upon the kinds of substrates and it was found that the Al-Mn material was the best.

As to the ordinary aluminum or aluminum alloy materials, the following seven kinds can be given:

(1) Pure Aluminum Base
(2) Aluminum - Manganese Base
(3) Aluminum - Copper Base
(4) Aluminum - Silica Base
(5) Aluminum - Magnesium Base
(6) Aluminum - Magnesium - Silica Base
(7) Aluminum - Zinc Base Out of these materials, the pure aluminum base, Al-Mn base, and Al-Mg base are appropriate, when corrosion resistance is taken into consideration. As the substrate of photoconductive material for use in electrophotography, it is an indispensable requirement to have a sufficient corrosion resistance.

Table 1 shows the examples of the pure aluminum base, the Al-Mn base, and the Al-Mg base.

Table 1

| Kind of Aluminum | JIS Symbol | Components (%) | | | | | | | |
|---|---|---|---|---|---|---|---|---|---|
| | | Cu | Si | Fe | Mn | Mg | Zn | Cr | Al |
| Al-Mn Base | 3003 | 0.2 or less | 0.6 or less | 0.7 or less | 1.0 — 1.5 | — — | 0.1 or less | — — | The Rest |
| Al-Mg Base | 5052 | 0.1 or less | 0.4 or less | | 0.1 | 2.2 — 2.8 | 0.1 or less | 0.15 — 0.35 | The Rest |
| Pure Al Base | 1080 | | | | — | | | | |

The present invention is explained in more detail by the following examples:

EXAMPLE 1

An aluminum drum (120 $\phi$) of the Al-Mn type shown in Table 1 was used as the substrate. The super-finishing was undertaken under the following condition:

Kind of Grinding Stone : FBB-GC 1000
Number of Vibration of Grinding Stone : 1.5
Grinding Speed : 300 mm/min
Number of Pass of Grinding Stone : Two times
Number of Rotations of Drum : 200–220 rpm
Grinding Liquid : Union Base + Kerosene (21/220l)

Under the above mentioned condition, the super-finished drums A–F were prepared with the pressure of the grinding stone being a parameter during this process.

Table 2 shows the average surface roughness of the respective super-finished drums.

Table 2

| Drum | Surface Roughness ($\mu$) |
|---|---|
| A | 0.1 |
| B | 0.3 |
| C | 1.1 |
| D | 1.9 |
| E | 2.5 |
| F | 14.2 |

Note: The surface roughness was measured by a Kosaka-type roughness meter (stylus contacting type)

Figure 3:
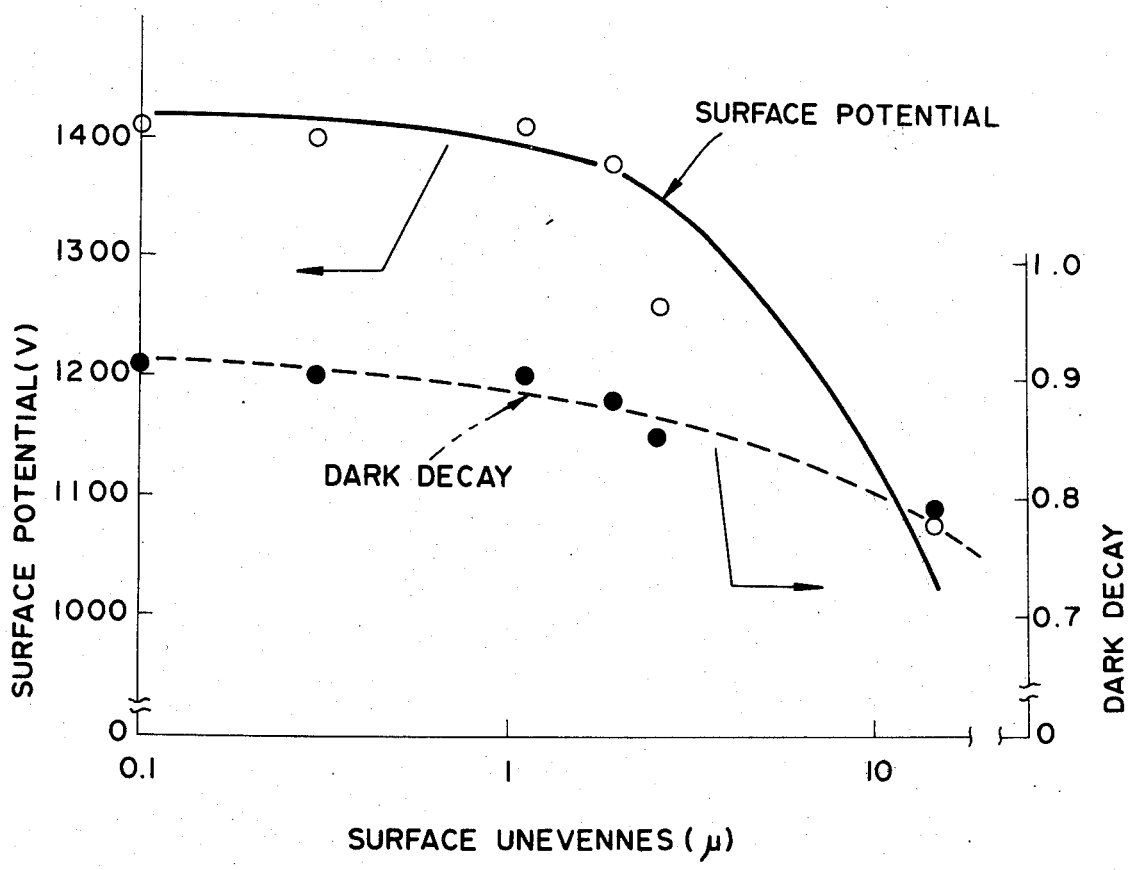
FIG. 3 shows the relationships between the electrostatic characteristics (surface potential and dark decay) and the surface roughness of a photosensitive material according to the present invention.

Table 3 and FIG. 3 show the measurement results of various characteristics of the photosensitive materials utilizing the above super-finish treated drums A and B on which about 50$\mu$ thick 5N selenium is deposited by vacuum evaporation at the substrate temperature of about 75° C.

Table 3

| Surface Drum | Surface Roughness ($\mu$) | Electrostatic Characteristics (1) | | | | |
|---|---|---|---|---|---|---|
| | | Dark Potential (V) | Surface Decay | Negative Adhesive-Potential (V) | Peeling ness (2) | Off (3) |
| A | 0.1 | 1410 | 0.91 | − 120 | X | 0 |
| B | 0.3 | 1400 | 0.90 | − 120 | 0 | 0 |
| C | 1.1 | 1410 | 0.90 | − 110 | 0 | 0 |
| D | 1.9 | 1380 | 0.88 | − 110 | 0 | 0 |
| E | 2.5 | 1260 | 0.85 | − 70 | 0 | 0 |

Table 3-continued

| Surface Drum | Surface Roughness (μ) | Electrostatic Characteristics (1) Dark Potential (V) | Surface Decay | Negative Adhesive-Potential (V) | Peeling ness (2) | Off (3) |
|---|---|---|---|---|---|---|
| F | 14.4 | 1080 | 0.79 | − 80 | 0 | X |

Note:
(1) Surface Potential: The potential of a photosensitive material after 20 seconds when charged at +5.7 kv of corona voltage.
Dark Decay : The ratio of the above surface potential Vs to the potential $V_0$ after standing in the dark for 20 seconds, namely the ratio Vo/Vs.Negative Surface Potential: The surface potential after 20 seconds when −7.5 kv of corona charge has been applied.
(2) A continuous copying test of 30,000 copies was conducted by a copying apparatus with a blade cleaning device. (0 indicates that the adhesiveness was so good that the peeling off of the photosensitive layer did not occur, while x indicates that the peeling off occurred.)
(3) After a continuous copying test of 30,000 copies, the Drum was heated to about 120° C and then it was tried to peel off the photosensitive layer. (0 indicates that the peeling off was possible, while x indicates that the peeling off was impossible.)

The above results and FIG. 3 show that the adhesiveness is satisfactory when the super-finished drum has a 0.3μ or more roughness.

With respect to the electrostatic characteristics, some changes were observed when the surface roughness became more than 2.0μ. As to the substrate, its surface roughness was appropriate in the range of 0.3 to 2.0μ. As to the peeling off of the photoconductive layer when the substrate is re-used, the permissible surface roughness of the substrate is up to about 10μ. The roughness of the selenium layer did not correspond directly to that of the substrate at the temperature of the substrate in the above example. It was found that the former became smaller than the latter.

EXAMPLE 2

An experiment was conducted under the same condition as in Example 1 except for the choice of the pure aluminum as a substrate. The results were satisfactory from all aspects so long as the surface roughness of the substrate was in the range of 0.3 to 2.0μ.

EXAMPLE 3

An experiment was conducted under the same condition as in Example 1 and Example 2 except for the choice of the Al-Mg base alloy as a substrate. The same result was obtained as in Example 1.

EXAMPLE 4

An experiment was conducted under the same condition as in Examples 1, 2 and 3 except for the choice of the stainless steel as a substrate. The same result was also obtained as in Example 1.

As mentioned in detail, the selenium photosensitive material according to the present invention has the advantages that the adhesiveness of the selenium layer to the substrates thereof is raised, a sufficient electrostatic characteristics for practical use is provided and the peeling off of the selenium layer is very easy when re-used.

EXAMPLE 5

Instead of the super-finished drum C (with Al-Mn type substrate), a selenium layer was formed on a super-finished drum with an Al-Mg base substrate under the same condition as in Example 1. The drum used in this experiment was the same drum as Drum C in Example 1 except for the substrate, that is, the substrate was of Al-Mg base in this experiment.

The electrostatic characteristics of the photosensitive material obtained by forming a selenium layer under the same condition as in Example 1 were investigated.

A sample of the photosensitive material was allowed to stand in the environment of 50° C. and after a predetermined period of time, the deterioration of the electrostatic characteristics of the sample was investigated.

Figure 4:
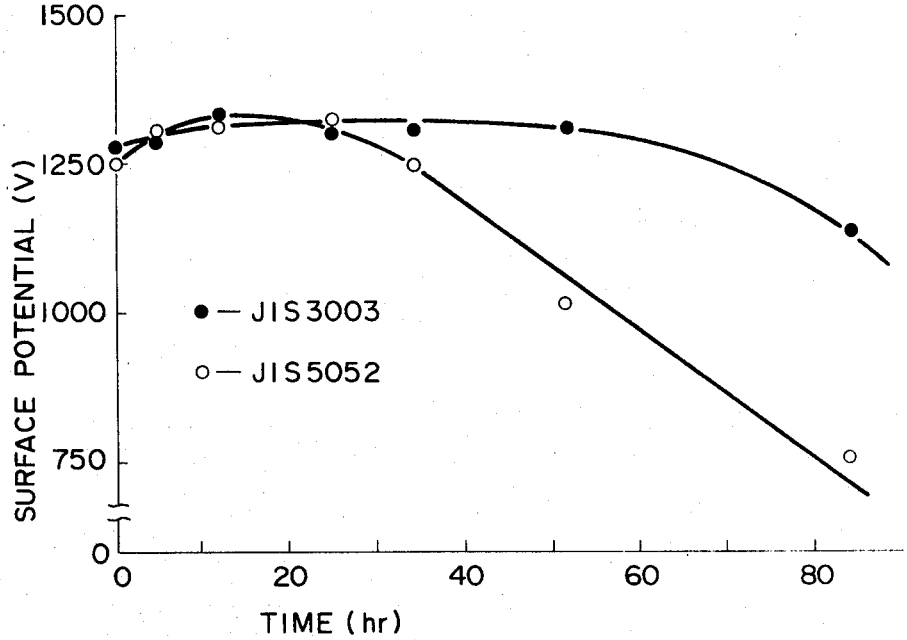
FIG. 4 shows the change of surface potential with time of a photosensitive material according to the present invention when an Al-Mn substrate or an Al-Mg substrate was used.

FIG. 4 is a graph showing the change of surface, potential with time. The surface potential (V) signifies the potential of the charged sample when +5.7 kv of electric charge has been applied to the sample for 20 seconds.

Figure 5:
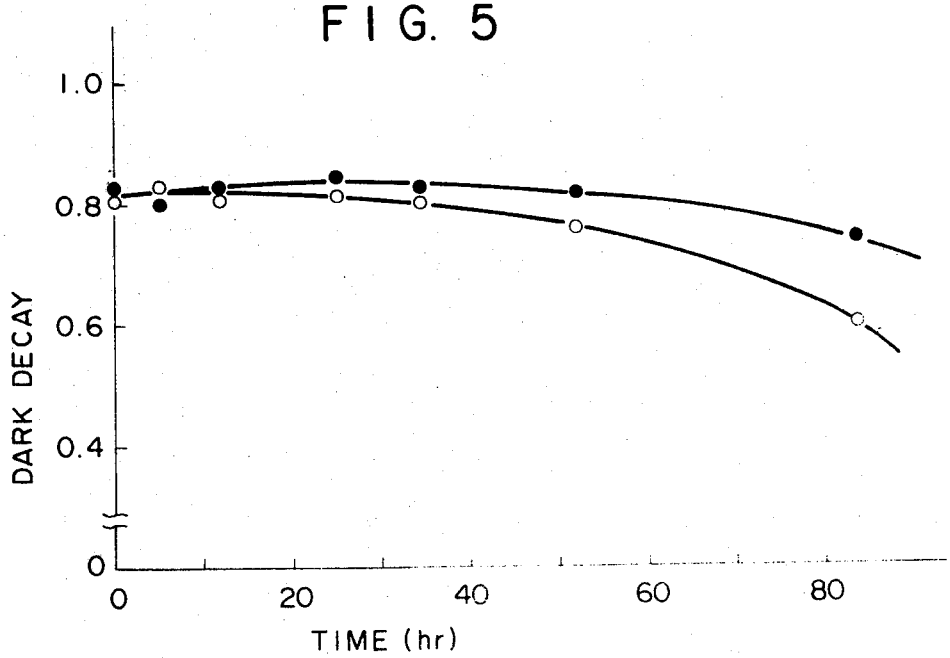
FIG. 5 shows the change of dark decay with time of the respective photosensitive materials of FIG. 4.

FIG. 5 shows the change of dark decay with time. The dark decay is represented by the ratio Vo/Vs, where Vs is the above mentioned surface potential and Vo is the potential of the charged sample after it has been allowed to stand in the dark for 20 seconds.

From FIG. 4 and FIG. 5, the selenium photosensitive material with the Al-Mn base substrate of JIS 3003 maintains the initial electrostatic characteristics even after about 50 hours. In contrast with this, the selenium photosensitive material with the Al-Mg base substrate showed a great deterioration of the electrostatic characteristics compared with the initial characteristics.

Consequently, it can be said that as a substrate for use in the electrophotographic selenium photosensitive materials, particularly when the substrate is super-finish treated, the Al-Mn base material is preferable with little change of the electrostatic characteristics of the photosensitive materials.

What is claimed is:

1. Improvement in an electrophotographic element comprising an electrically conductive metal substrate having a surface coated with and completely covered by a photoconductive layer of photoconductive selenium or photoconductive selenium alloy, wherein the improvement consists of:

the roughness of said surface of said substrate is in the range of from about 0.3 to about 2.0 microns and said surface of said substrate is free of long periodical undulations, said substrate having been prepared by superfinishing said surface of said substrate.

2. An electrophotographic element as claimed in claim 1 wherein said photoconductive layer comprises a member selected from the group consisting of selenium, selenium-tellurium alloy, selenium-arsenic alloy, and selenium-tellurium-arsenic alloy.

3. An electrophotographic element as claimed in claim 1 wherein said substrate comprises a member selected from the group consisting of aluminum, stainless steel and brass.

4. An electrophotographic element as claimed in claim 1 wherein said substrate comprises aluminum-manganese alloy.

5. An electrophotographic element as claimed in claim 1 wherein the surface of said photoconductive layer is protected with an overcoat layer.

6. An electrophotographic element as claimed in claim 1 in which the superfinishing is performed by applying to said surface of said substrate a superfinishing grinding stone under a pressure of 0.8 ± 0.1 $Kg/cm^2$, vibrating said grinding stone at a rate of 2000 to 2500 cycles per minute at an amplitude of 1.5 to 2.5 mm, rotating said grinding stone at 200 to 250 rpm and moving said grinding stone at a rate of 250 to 350 mm/min relative to said surface of said substrate while applying a superfinishing grinding liquid to said surface of said substrate.

7. An electrophotographic element as claimed in claim 1 in which said substrate has the composition Cu: up to 0.2 wt. %
Si: up to 0.6 wt. %
Fe: up to 0.7 wt. %
Mn: 1.0 to 1.5 wt. %
Zn: up to 0.1 wt. %
Al: balance.

8. An electrophotographic element as claimed in claim 1 in which the thickness of said photoconductive layer is from about 30 to about 80 microns.

9. An electrophotographic element as claimed in claim 1 which possesses a surface electric potential of more than 1250 V and a dark decay of more than 0.80, wherein surface electric potential (Vs) is the potential of the surface of said photoconductive layer after charging same at +5.7 KV corona discharge voltage for 20 seconds and dark decay is Vo/Vs wherein Vo is the surface electric potential of said surface of said photoconductive layer after said surface has stood in the dark for 20 seconds after terminating said corona discharge voltage.

* * * * *